US006779210B1

(12) United States Patent
Kelly

(10) Patent No.: US 6,779,210 B1
(45) Date of Patent: Aug. 24, 2004

(54) ELEVATING BED

(76) Inventor: Hugh Kelly, 30 Hawthorn Road, Doveton, Victoria 3177 (AU)

( * ) Notice: Subject to any disclaimer, the term of this patent is extended or adjusted under 35 U.S.C. 154(b) by 0 days.

(21) Appl. No.: 10/391,985

(22) Filed: Mar. 18, 2003

(51) Int. Cl.[7] ..... A47B 7/00
(52) U.S. Cl. ..... 5/611; 5/610; 5/11
(58) Field of Search ..... 5/11, 10, 611; 108/147, 147.19

(56) References Cited

U.S. PATENT DOCUMENTS

| | | | | | |
|---|---|---|---|---|---|
| 1,096,316 | A | * | 5/1914 | Noble | 5/11 |
| 3,015,113 | A | * | 1/1962 | Wallen | 5/11 |
| 3,050,744 | A | * | 8/1962 | Mann et al. | 5/11 |
| 3,105,246 | A | * | 10/1963 | Emrick | 5/11 |
| 3,230,553 | A | * | 1/1966 | Schlackman et al. | 5/611 |
| 5,343,581 | A | | 9/1994 | Bartley et al. | |
| 5,802,639 | A | * | 9/1998 | Raasch et al. | 5/611 |
| 6,505,365 | B1 | * | 1/2003 | Hanson et al. | 5/613 |

FOREIGN PATENT DOCUMENTS

| | | |
|---|---|---|
| AU | 78108/81 | 6/1982 |
| AU | 47184/89 | 6/1990 |
| AU | 81153/91 | 1/1992 |
| AU | 86928/91 | 6/1992 |
| DE | 3902396 | 9/1989 |
| DE | 4334343 | 4/1995 |
| EP | 0 617 945 | 10/1994 |
| FR | 2674430 | 10/1992 |
| WO | 93/05745 | 1/1993 |
| WO | 94/02054 | 2/1994 |
| WO | 95/08315 | 3/1995 |
| WO | 98/20829 | 5/1998 |
| WO | 98/43001 | 10/1998 |
| WO | 99/19247 | 4/1999 |
| WO | 00/62731 | 10/2000 |
| WO | 00/66061 | 11/2000 |
| WO | 01/17476 | 3/2001 |
| WO | 01/45626 | 6/2001 |

* cited by examiner

*Primary Examiner*—Michael F. Trettel
(74) *Attorney, Agent, or Firm*—Smith-Hill and Bedell

(57) ABSTRACT

A patient's bed has a mattress support 6 carried by two bed ends each of which has a rise and fall travel beam. The beams stay parallel to the ground but adopt any inclination in response to an electric screw drive operated from a hand held cable connected control.

13 Claims, 4 Drawing Sheets

ELEVATING BED

FIELD OF THE INVENTION

This invention concerns patients beds of adjustable height.

BACKGROUND OF THE INVENTION

Hospitals and nursing homes devote increasing care to aging populations. In aging patients, dementia, confusion and behavior modified by medication, means that even simple operations such as transferring patients in and out of bed brings some risks. Injury from falling out of bed is not uncommon when non-elevating beds arm used. This risk is reduced by introducing beds which rise and fall so that the patient can sleep close to the floor. When the patient is ready to stand up, the bed is raised so that the patient can be seated in the bed with their feet on the floor. Further rising assists the patient to stand. Their bed movements must be controlled by staff who use bed movement in combination with chairs, trolleys, patient lifters and other ancillary equipment which avoids the need for the nursing staff to lift the patient. The bed movement at or close to floor level is crucial to cooperating with such equipment. The carriages of the equipment must underlie the bed frame during patient transfer and accordingly the bed frame thickness must be minised because to this thickness must be added the mattress thickness. Such mattresses commonly have a concave upper face to centralise the patient and to act as a Sanity barrier to falling out of bed.

Mattress contouring was introduced to replace the use of cot type restraints which breached operating protocols concerning the freedom of the patient.

SUMMARY OF THE INVENTION

The apparatus aspect of the invention provides a patients' bed of adjustable height comprising a rise and fall bed frame supported between two ends, wherein the rise and fall of each end of the frame is controlled by a motor or an equivalent, wherein the mattress fay is capable of descending floor.

Patients may spend their sleeping hours at a beat equal to the thickness of the mattress plus the thickness of the bed fame.

The ends have frame guides which allow the frame to rise and fall parallel to the ground. The Same may have a mattress support capable of inclination to allow passage of the bed through a door.

The end may have vertical guides along which the ends of a cross bar rise and fall. The ends may support a motor mount, and a motor may drive a screw which engages a nut on the cross bar.

Preferably the motors are controlled for both synchronous rise and fall of the bed frame and a synchronous rise and fall so that the patient can be rested at a desired inclination to assist blood flow.

The motors may be supplied from a 24v dc power pack with means to vary the quantity of current proportionate to the load. The fame may be detachable from the ends for freight convenience.

In an alternative version there may be a motor at each corner of the bed. In such an arrangement the motors in each may work as pairs. The frame may be generally planar with a mattress tray. Conveniently, and in accordance with estabisied practice, the tray may be hinged between the ends so that the patients torso can be raised. This is achieved by a ram fixed at the frame beneath the mattress tray.

BRIEF DESCRIPTION OF THE VIEWS OF THE DRAWINGS

One embodiment of the invention is now described by way of example with reference to the drawings in which.

DETAILED DESCRIPTION WITH RESPECT TO THE DRAWINGS

Figure 1:
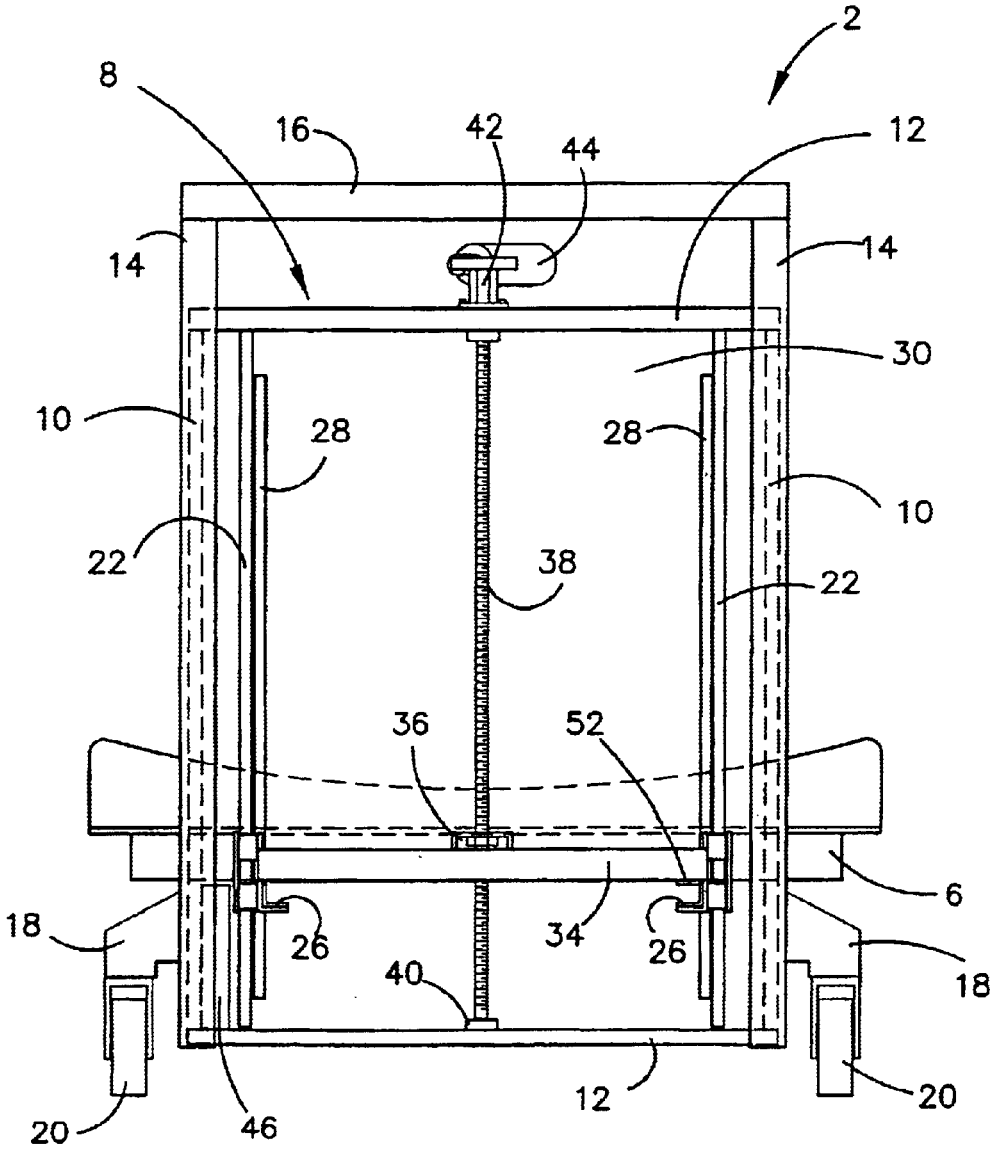
FIG. 1 is an end view of the bed.
Figure 2:
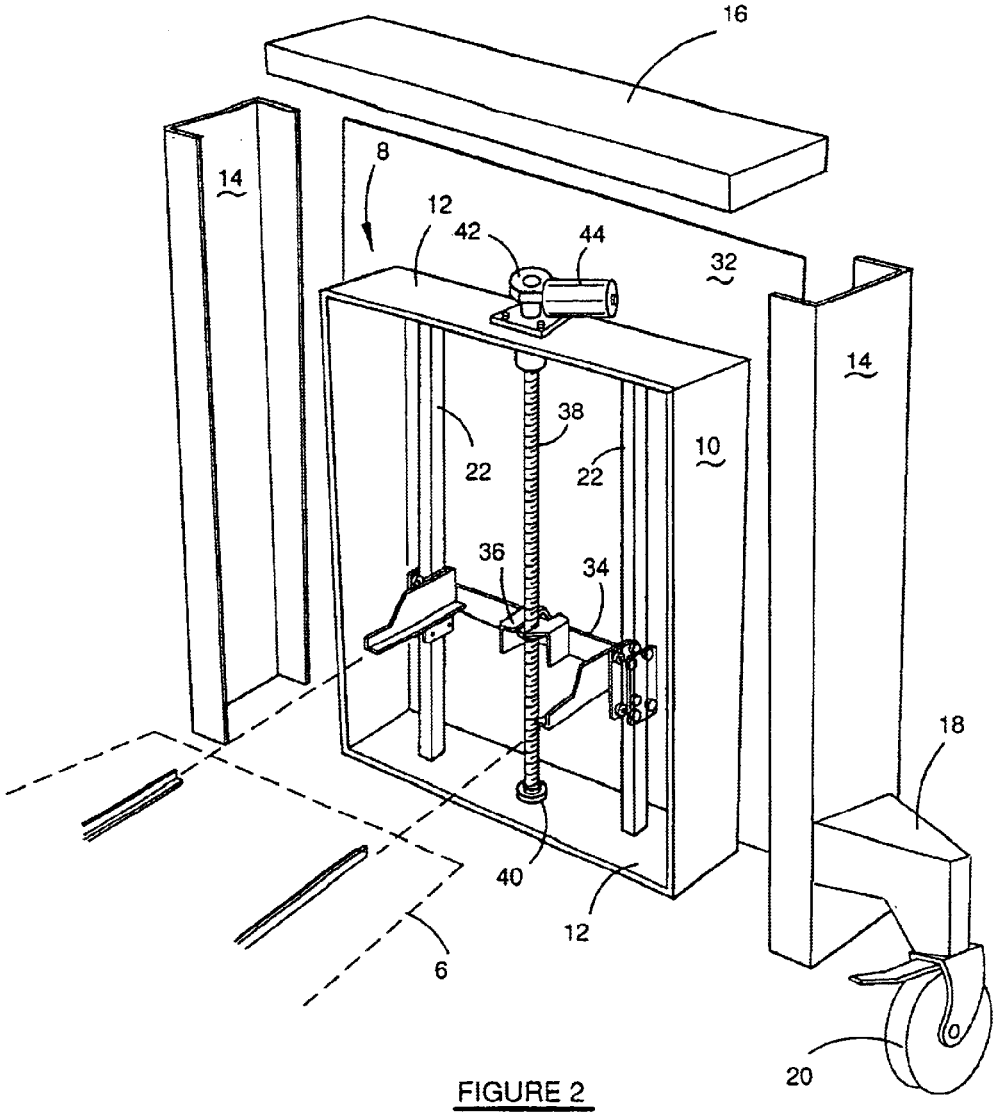
FIG. 2 is an exploded view of an end of the bed.
Figure 3:
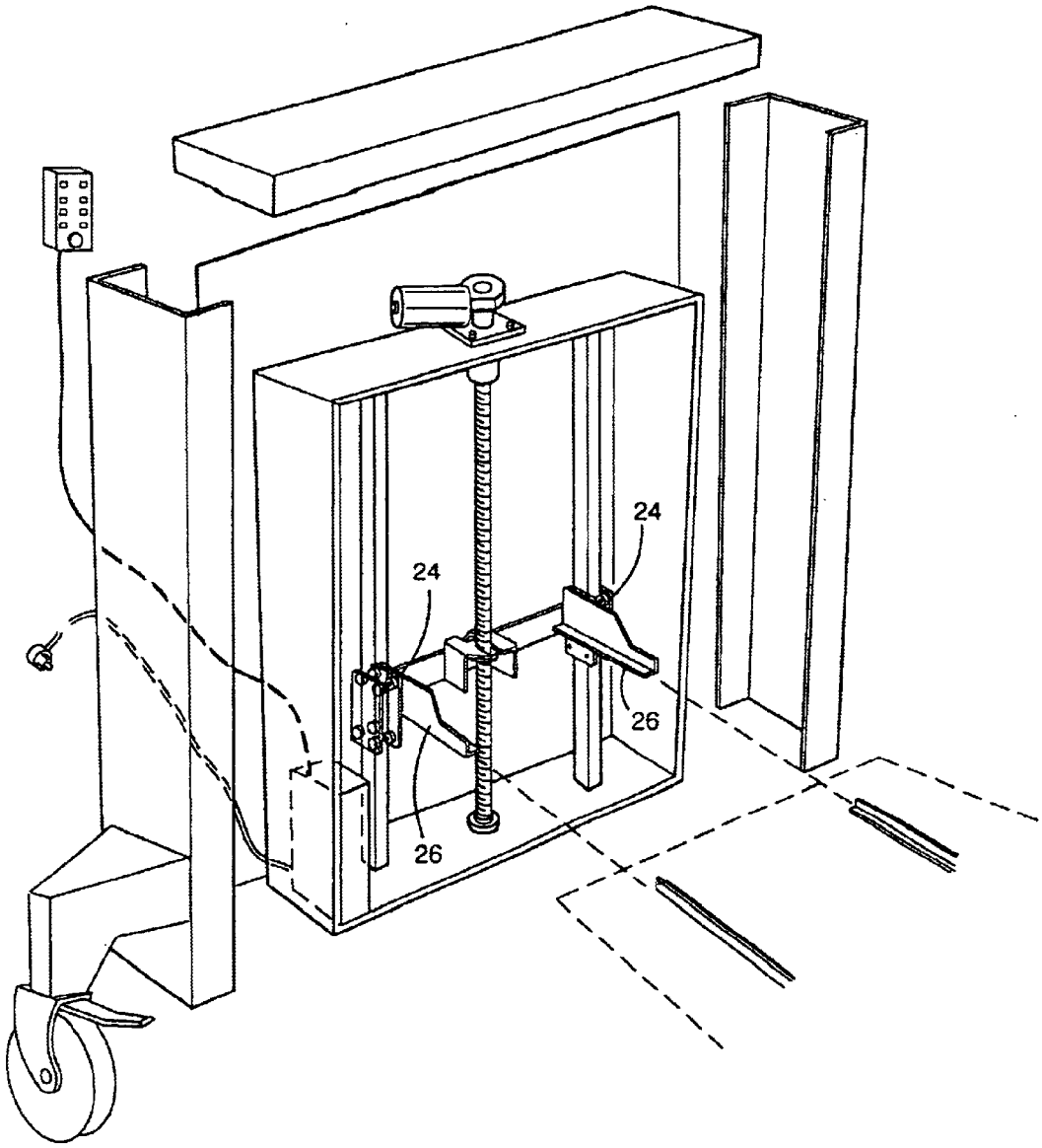
FIG. 3 is analogous to FIG. 2.
Figure 4:
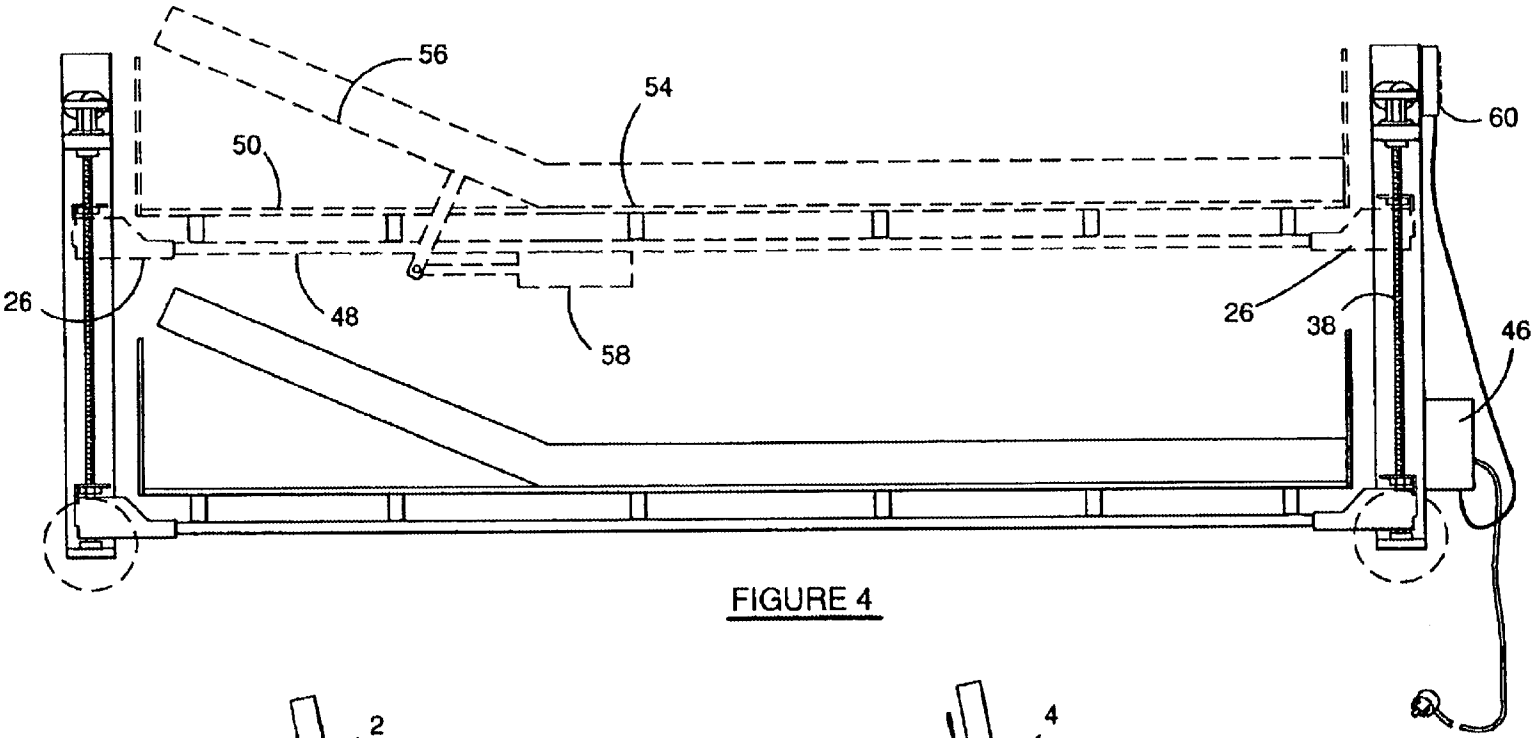
FIG. 4 is a side elevation of the bed showing normal and lowered positions.
Figure 5:
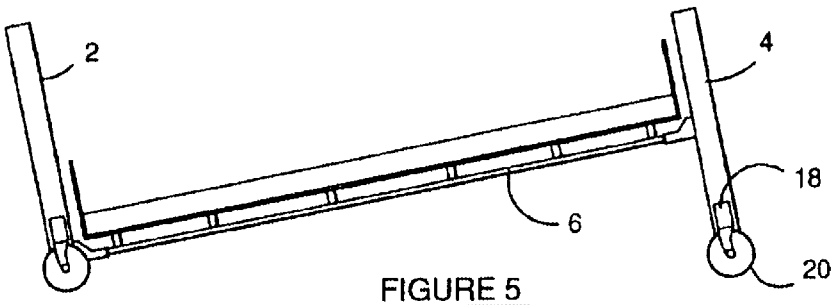
FIG. 5 shows the geometry of the bed when tilted to the maximum.

Referring now to the drawings, the bed comprises a head end 2, a foot end 4 and a rise and fall mattress support 6. The ends are the same and consist of an internal upstanding rectangular frame 8 made of bolt together, flanged sheet steel styles 10 and rails 12. Internal frame 8 supports an external frame made of C-shaped steel pillars 12 and beams 16. Feet 18 carry castes 20.

The internal frame supports a pair of square section hollow tubes 22 which act as linear motion guides for a pair of cares 24 which ride up and down the guides. The carriages have wheels which roll on the front and rear faces of the tubes 22. The carriages each have a bracket 26 which project through slots 28 in a front panel(see FIG. 1). The panel extends from pillar to pillar and corresponds to Ear panel 32.

The brackets 26 are section and support the bed frame 6. The carriages are linked by a cross member 34 which has a fabricated nut assembly 36. The cross member rises and falls between the top and bottom rail 12 and is driven by a screw 38. The screw has a buttress thread and is seated in a thrust bearing 40 located in the bottom rail 12. The screw has a square upper end (not shown) which projects into the socket of a worm and pinion gearbox 42 bolted to the top rail 12. 24 v dc motor 44 is integral with the gearbox.

LINAK™ motors are supplied to the industry by the Swedish company of that name. They incorporate reed switches (not shown) for sensing the resistance to the motor torque in order to vary the current appropriately from a power pack 46 supplied by mains current in the ward.

The cross member remains parallel to the floor. The mattress support 6 is bolted to brackets 26. Bearers 48 supports sheet metal mattress tray 50. The tray has hinge mounts 52 (see FIG. 1). The mattress tray has a leg section 54 and a torso section 56. The latter is raisable by a ram 58 underneath the leg section. This ram is a standard feature of patients beds.

The powerpack 46 supplies motors separately with current via a hand held control 60. The switch for each motor allows an operator to impose an inclination on the bed frame at any height. It is possible for the top of the mattress tray to descend to 90 mm above the floor. If a patient rolls off the mess, injury is unlikely at this height If a lifting carriage is wheeled up to the bed, the frame is raised to allow the carnage to project beneath The after the height can be adjusted in accordance with the size and mobility of the patient.

We have found the advantages of the above embodiments to be:

1. Sleeping height may be very close to the floor precluding injury.

2. A variety of inclinations are possible, eecially when a hinged mattress tray is used.

3. Simple construction and assembly techniques reduce the cost of manufacture.

In a non-illustrated version a pair of scow drives at both ends enable the patient to be tilted out of the bed onto a trolley.

It is to be understood that the word "comprising" as used throughout the specification is to be it repeated in its inclusive form, ie. use of the word "comprising" does not exclude the addition of other elements It is to be understood that various modifications of and/or additions to the invention can be made without depart from the basic nature of the invention. These modifications and/or additions are therefore considered to fall within the scope of the invention.

A fluid operated ram and a mechanical jack are examples of equivalents to the motor and screw.

What is claimed is:

1. A patient's bed of adjustable height comprising two bed ends and a rise and fall mattress support supported by the two bed ends, each bed end comprising:

an outer frame, a static frame stationary secured within Lie outer frame and having a pair of styles joined by an upper rail and a lower rail, a pair of upright, mutually parallel carriage guides positioned inboard of the styles, a pair of carriages slidably engaging the carriage guides respectively, a cross member mutually connecting the carriages and free to ride between a high position and a low position, the mattress support being borne by the cross member and free to ride with the cross member, a nut fixed to the cross member, a screw extending between the upper and lower rails, the screw being in threaded engagement with the nut, and a drive mechanism mounted to the bed end and coupled to the screw for rotating the screw relative to the nut.

2. A patient's bed according to claim 1, wherein the guides have a pair of opposed faces and the carriages have wheels which run on said opposed faces.

3. A patient's bed according to claim 2, wherein the guide's opposed faces are parallel to one another.

4. A patient's bed according to claim 2, wherein the guides are square sectioned tubes.

5. A patient's is bed according to claim 2, wherein the carriages each have two mutually spaced pairs of wheels.

6. A patient's bed according to claim 1, comprising a thrust bearing mounted to the lower rail and against which the screw reacts.

7. A patient's bed according to claim 1, wherein the drive mechanism of each bed end comprises a motor and the motors are controllable for both synchronous and a synchronous rise and fall.

8. A patients bed according to claim 1, wherein the drive mechanism of each bed end comprises a motor and the motors are dc motors with means to vary the current proportionally to the load.

9. A patient's bed according to claim 1, wherein the mattress support is detachable from the bed ends.

10. A patient's bed according to claim 1, wherein the rise and fall of one end of the mattress support is controlled by a pair of motors.

11. A patient's bed according to claim 1, wherein the mattress support is capable of inclinations about a horizontal longitudinal axis.

12. A patient's bed according to claim 1, wherein the outer frame comprises a pair of legs for supporting the bed, said legs being vertical.

13. A patient's bed of adjustable height comprising two bed ends and a rise and fall mattress support supported by the two bed ends, each bed end comprising:

a first leg and a second leg, each leg having a lower end and an upper end and having a wheel attached in proximity to the leg's lower end, an upper crossbar joining the first leg to the second leg, the upper crossbar being attached to the first leg in proximity to the first leg's upper end and attached to the second leg in proximity to the second leg's upper end, a pair of upright, mutually parallel carriage guides positioned in board of the first and second legs, a pair of wheeled carriages engaging each carriage guide respectively, a cross member mutually connecting the carriages and free to ride between a high position and a low position, the mattress support being borne by the cross member and free to ride with the cross member, a nut fixed to the cross member, a screw extending between the upper and lower rails, the screw being in threaded engagement with the nut, and a drive mechanism mounted to the bed end and coupled to the screw for rotating the screw relative to the nut.

* * * * *